United States Patent [19]

Sherby et al.

[11] 4,448,613

[45] May 15, 1984

[54] DIVORCED EUTECTOID TRANSFORMATION PROCESS AND PRODUCT OF ULTRAHIGH CARBON STEELS

[75] Inventors: Oleg D. Sherby; Toshimasa Oyama, both of Palo Alto; Jeffrey Wadsworth, Menlo Park, all of Calif.

[73] Assignee: Board of Trustees, Leland Stanford, Jr. University, Stanford, Calif.

[21] Appl. No.: 381,194

[22] Filed: May 24, 1982

[51] Int. Cl.[3] ..... C21D 8/00

[52] U.S. Cl. ..... 148/12 R; 148/134

[58] Field of Search ..... 148/12 R, 36, 12 B, 148/134

[56] References Cited

U.S. PATENT DOCUMENTS 3,951,697 4/1976 Sherby et al. ..... 148/12 R

*Primary Examiner*—Peter K. Skiff

*Attorney, Agent, or Firm*—Fulwider, Patton, Rieber, Lee & Utecht

[57] ABSTRACT

An ultrahigh carbon steel consisting of a structure formed by divorced eutectoid transformation with or without accompanying deformation such that substantially no pearlite is formed, having a fine grained iron matrix stabilized by cementite in spheroidized form. A method for processing the steel including heat treatment and mechanical working to form spheroidized proeutectoid carbide particles then reheating the steel for a time such that the carbon is not uniformly distributed in the austentite so that upon cooling, with or without accompanying deformation, a divorced eutectoid transformation occurs leading to a structure of spheroidized cementite in a fine ferrite grain matrix.

9 Claims, 11 Drawing Figures

(a)

(b)

(c)

(a)

(b)

(a)

(b)

(c)

DIVORCED EUTECTOID TRANSFORMATION PROCESS AND PRODUCT OF ULTRAHIGH CARBON STEELS

The U.S. Government has a paid-up license to this invention as provided for by the terms of Contract No. DAAG29-81-K-0080 awarded by DARPA.

BACKGROUND OF THE INVENTION

1. Field of the Invention

This invention relates to ultrahigh carbon steels and methods of thermomechanical processing ultrahigh carbon (UHC) steels such that the steels are fine grained and spheroidized.

2. Description of the Prior Art

A class of steels known as ultrahigh carbon (UHC) steels has been developed by Sherby et al. and described in U.S. Pat. No. 3,951,697 issued Apr. 20, 1976. These UHC steels are typically plain carbon steels containing between 1.0–2.1% carbon by weight, although they can contain small alloying additions (<2%) of elements such as Cr, Si, V, etc. Conventional steels contain between 0.1 and 0.8% C and cast irons contain over 2.1% C. Thus, UHC steels are intermediate in carbon content between the two groups of iron-based materials.

These UHC steels have been processed to have a fine-grained microstructure containing spheroidized cementite particles. In this condition the steels are superplastic in the temperature range 600°–850° C. Superplasticity is the ability of certain materials to undergo extensive neck-free elongations. This property can be utilized in the manufacture of complex shapes. In addition, because of their fine structure, UHC steels can be bonded readily to themselves or other ferrous alloys in the solid-state at temperatures that are much lower than those used commercially for bonding of steels. As is generally found with other fine structures, at room temperature, UHC steels have good strength, ductility and toughness. Finally, the UHC steels can be heat treated by quenching, and, because of the high carbon content, extremely-high hardnesses can be developed.

The Sherby patent teaches the desirability of having the cementite in the ferrite-cementite region in spheroidized form rather than in lamellar form. In that patent, a number of thermomechanical processing techniques are described to accomplish the formation of spheroidized cementite particles in fine-grained ferrite. These techniques involve a homogenization step in which, by heating the steel into the single-phase austenite region, austenite having a uniform carbon content is created. Following the homogenization, a number of techniques are described to refine the iron grain and obtain cementite in spheroidized form. These techniques all require large strains during warm working in the ferrite-cementite region to develop the desired structure. In addition to the requirement of large strains, all of the techniques described in the patent also require isothermal deformation at some point in the processing. These requirements are undesirable because of the uneconomical aspect of such practices. No consideration is given to the utilization of the divorced eutectoid transformation in the processing techniques described in the Sherby patent.

The divorced eutectoid transformation, in which the eutectoid transformation proceeds by the formation of spheroidized carbides and ferrite instead of lamellar pearlite, was observed by Honda and Saito in 1920 in an academic investigation. In another more recent study, Nakano et al. have described the "Effects of Chromium, Molybdenum and Vanadium on Spheroidization of Carbides on 0.8% Carbon Steel" (Transaction ISIJ, Vol. 17, 1977). They showed that the divorced eutectoid transformation could occur in their steels upon slow cooling (20° C./hour) from above the $A_1$ transformation temperature. They emphasized that the degree of spheroidization was a function of austenitizing temperature and the authors were primarily only interested in the influence of Cr, Mo and V on the degree of spheroidization. No mechanical working was carried out concurrently with the DET. In addition, Nakano et al. worked only with steels having carbon contents significantly less than UHC steels. The major difference between the UHC steels and 0.8% C steels is the large amount of pro-eutectoid carbide present in UHC steels. This pro-eutectoid carbide has to be processed into spheroidized form in order to obtain the desired final microstructure claimed in this application.

SUMMARY OF THE INVENTION

In accordance with the present invention, an ultrahigh carbon steel is formed by a thermomechanical processing route incorporating a divorced eutectoid transformation. The steel product has a microstructure with a stabilized iron matrix of a fine grain size, substantially no pearlite, and cementite in predominantly spheroidized form.

The invention has advantages over existing processess or prior art in that the invention utilizes an unusual solid state transformation herein called the "Divorced Eutectoid Transformation" (DET). Utilizing this solid state transformation, with or without associated deformation, it is possible to make UHC steels fine-grained and spheroidized in a more economical way than has previously been established. If the thermomechanical processing involves a Divorced Eutectoid Transformation without additional deformation the process is called a DET process. If the thermomechanical processing involves a Divorced Eutectoid Transformation With Associated Deformation the process is called a DETWAD process. If deformation immediately precedes the Divorced Eutectoid Transformation it is called a DETWAD I process. If deformation both precedes and follows the Divorced Eutectoid Transformation, the process is known as a DETWAD II process.

There are two key thermomechanical processing stages to develop the desired fine structure in UHC steels. In the first, a thermomechanical processing step is carried out to develop proeutectoid cementite in substantially spheroidized form. In the second step, the DET or DETWAD process is utilized to convert the structure from pearlite to spheroidized cementite in fine ferrite. A number of techniques set forth hereinafter may be employed to accomplish the divorced eutectoid transformation and the formation of the fine iron grain and spheroidized cementite. These include the DET, DETWAD I and DETWAD II. The advantages of these processes over prior art include: (1) decrease in the warm working strain required to form fine-structured UHC steels; (2) reduction of required forces because deformation occurs predominantly above the $A_1$ temperature; and (3) avoidance of isothermal deformation processing. These advantages make mass production of UHC steel considerably easier than the prior art.

BRIEF DESCRIPTION OF THE DRAWING

In the present invention, several variations of the methods are contemplated by the inventors. While the specification concludes with claims particularly pointing out and distinctly claiming the subject matter regarded as forming the present invention, it is believed that the invention and its advantages will be better understood from the following description of the preferred methods taken in connection with the accompanying drawings in which:

FIG. 10(*a*) is for UHC steel without Cr (1.75% C+1.0% Mn); and FIG. 10(*b*) is for a UHC steel with Cr (1.5% C+0.5% Mn+1.3% Cr).

DETAILED DESCRIPTION OF THE INVENTION

Figure 1:
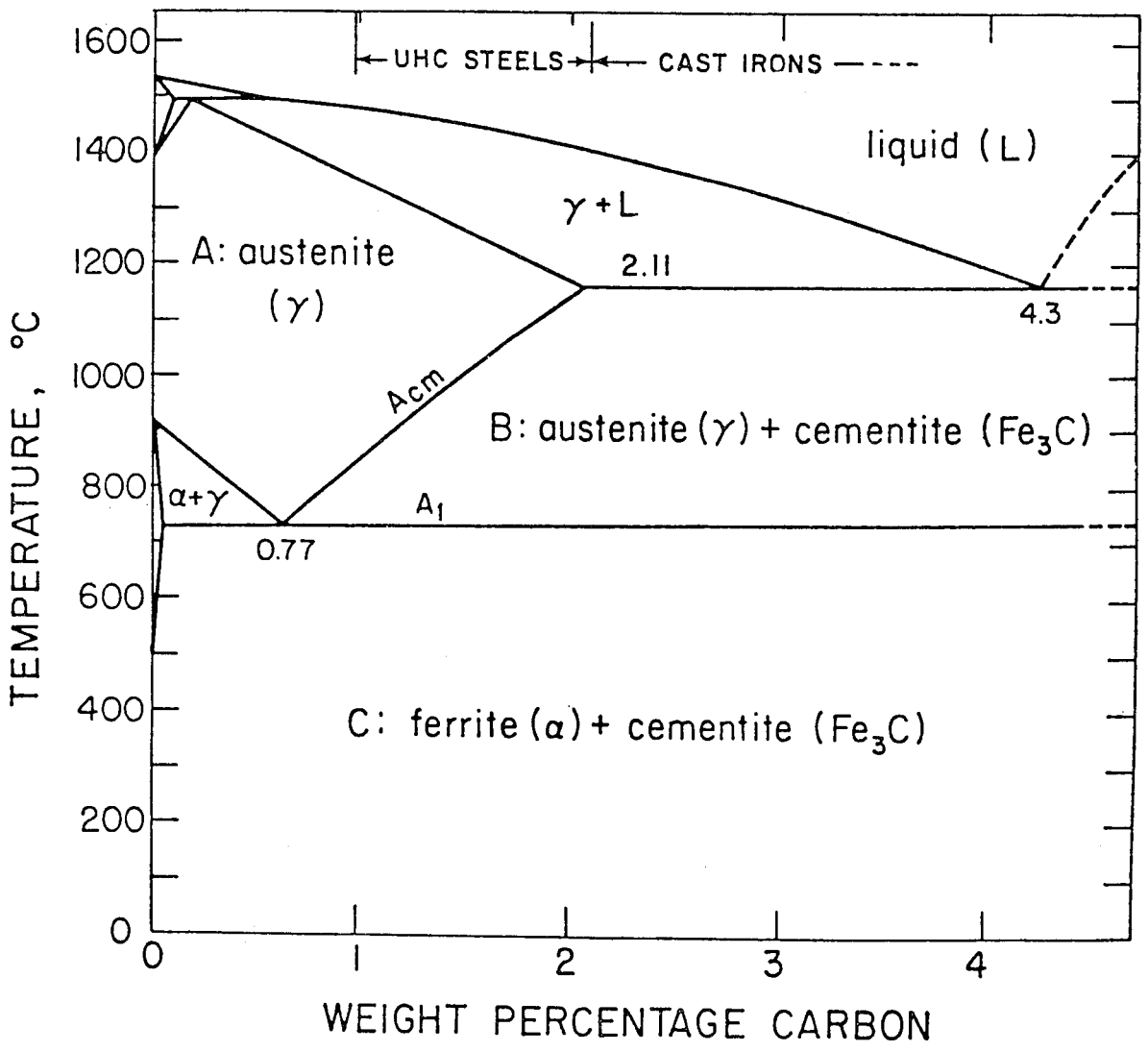
FIG. 1 is the phase diagram of iron-cementite.

Now turning to FIG. 1, the phase diagram of iron-cementite (cementite is also known as carbide or iron carbide) can be broken into several regions for the purpose of describing the present invention:

Region A is an austenite region, single-phase, in which all the carbon is in solution under equilibrium conditions.

Region B is an austenite-plus-cementite region above 727° C. The cementite in this region is known as proeutectoid cementite.

Region C is a ferrite-plus-cementite region, below 727° C. The cementite that forms below the $A_1$ temperature is known as eutectoid cementite.

The $A_{cm}$ temperature is the transformation temperature between the austenite and the austenite-plus-cementite regions. The $A_1$ transformation temperature is the temperature at which the eutectoid transformation occurs. A eutectoid transformation involves the formation of two solid phases from one upon cooling. This transformation in steels is from austenite of eutectoid composition (~0.77% C) to ferrite and cementite. Usually, the ferrite and cementite forms in a lamellar structure known as pearlite.

"Steel" is commonly defined as an iron-base alloy containing maganese, usually carbon and other elements. "Ultrahigh Carbon" (UHC) steel is defined as steel with a carbon content substantially in excess of the eutectoid composition (0.77%) i.e., 1.0% to possibly as high as 2.1%. A typical carbon range for a UHC steel is in the range of 1.3%–1.9%. Ultrahigh carbon steel can be formed by conventional casting techniques.

Cementite is a compound of iron and carbon known chemically as iron carbide and having the approximate chemical formula $Fe_3C$. It is characterized by an orthorhombic crystal structure. When it occurs as a phase in steel, the chemical composition will be altered by the presence of manganese and other carbide forming elements.

Martensite is an unstable constituent in quenched steel formed without diffusion.

Austenite is a solid solution of carbon in face-centered-cubic iron.

The term "fine-grained" will be used herein to describe iron having an average linear intercept grain size, $\bar{L}$, of 10 microns or less.

"Hot working" refers to deformation above a temperature of about 0.65 $T_M$ where $T_M$ is the melting point in degrees Kelvin. "Warm working" refers to deformation above about 0.35 $T_M$ but below about 0.65 $T_M$.

The term "soaking" will be used herein to describe prolonged heating of a metal at a selected temperature.

For clarity of description, the methods for forming the ultrahigh carbon steel by Divorced Eutectoid Transformation (DET), Divorced Eutectoid Transformation With Associated Deformation where the deformation immediately precedes the Divorced Eutectoid Transformation (DETWAD I) and Divorced Eutectoid Transformation With Associated Deformation where the deformation precedes, accompanies and follows the Divorced Eutectoid Transformation (DETWAD II) will be set forth below. In the first three method descriptions (Methods One, Two and Three), homogeneous austenite is the starting structure and the complete processing required, involving DET, DETWAD I or DETWAD II, to obtain the desired microstructure is described. In the next three method descriptions (Methods Four, Five and Six) the starting structure consists of substantially spheroidized proeutectoid cementite in a matrix of eutectoid carbide and ferrite or in a matrix of martensite, and the complete processing required, involving DET or DETWAD I or DETWAD II, to obtain the desired microstructure is described.

METHODS ONE, TWO AND THREE INVOLVING TWO PROCESSING STAGES

Method One

Figure 2:
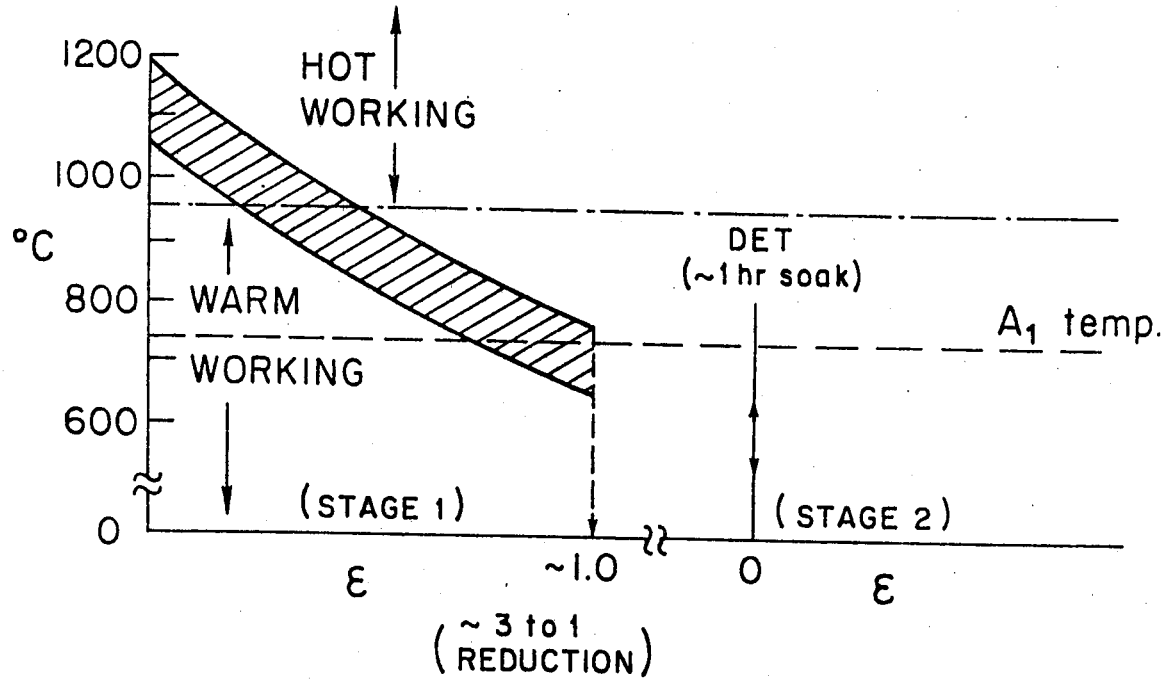
FIG. 2 is a schematic diagram representing the processing stages of Method One involving DET.
Figure 3:
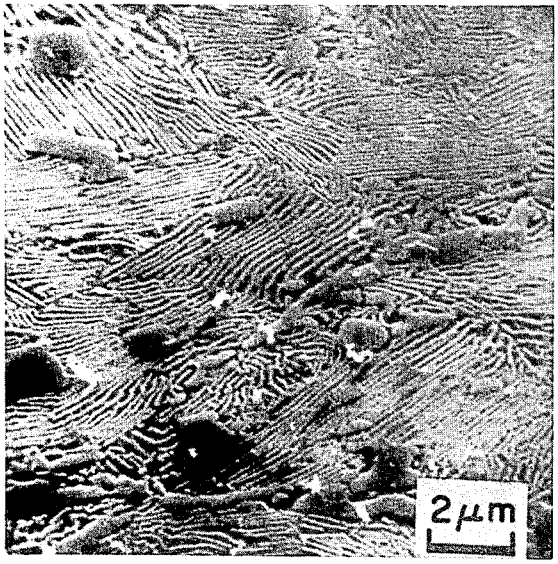
FIG. 3 shows two examples of the microstructure after the first processing stage of Method One, Two and Three.
Figure 3:
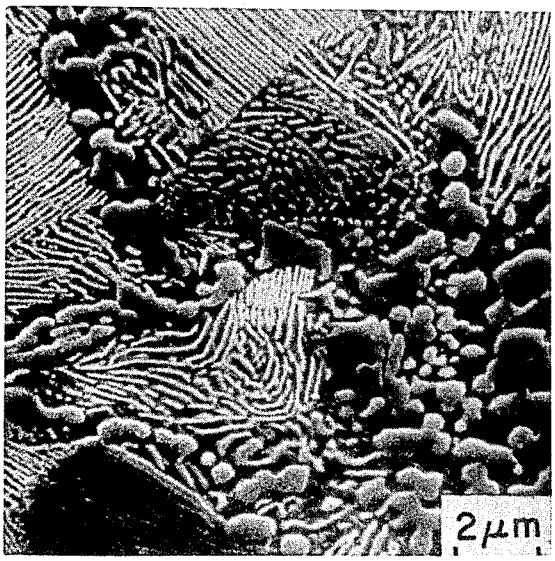
Figure 4:
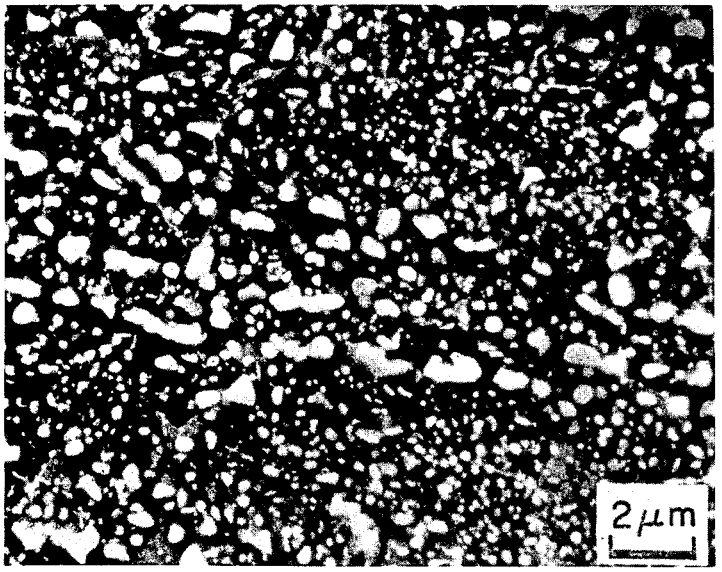
FIG. 4 is an example of the microstructure obtained from the processing stages of Method One.

In a Method One, two processing stages are used to obtain the desired structure. A schematic of a Method One is shown in FIG. 2 for 1.5% C steel containing 1.5% Cr, 0.5% Mn and 0.5% Si. In the first stage an intermediate structure of spheroidized, pro-eutectoid cementite in a matrix of pearlite is obtained. This structure is achieved by deforming (hot and warm working) the UHC steel during cooling from a temperature in excess of the $A_{cm}$ transformation temperature in the single-phase austenite range (e.g., 1050° to 1200° C.) to an intermediate temperature about the $A_1$ transformation temperature (in the range 650°–800° C.) followed by air cooling to below the $A_1$ transformation temperature. A typical microstructure obtained after the first stage is shown in FIG. 3. The second stage involves the DET process. In this stage the UHC steel is reheated to above the $A_1$ transformation temperature (approximately 780° C.) for about one hour such that pearlite is mostly dissolved into austenite in which the carbon is not uniformly distributed (Mehl and Hagel, *Progress in Metal Physics,* Vol. 6, 1956, p.74–134). The austenite will have a fine grain size because grain growth is inhibited by the presence of the spheroidized pro-eutectoid carbides. The UHC steel is then air cooled below the $A_1$ transformation temperature to produce a structure of fully spheroidized cementite in a fine ferrite matrix. An example of this microstructure is shown in FIG. 4. Normally one would expect a pearlite structure upon cooling from above the $A_1$. However, because of the inhomogeneities of carbon distribution in austenite, and the presence of pro-eutectoid carbides, the carbides that form upon transformation do not develop a lamellar structure. Instead, they either nucleate and grow within the imhomogeneous austenite regions where the carbon content is high, or, they precipitate on pre-existing pro-eutectoid carbides. This process, Method One, utilizing DET, has advantages over the prior art of manufacturing UHC steels in that the strain required to produce a fine grained, fully-spheroidized structure is greatly reduced.

The time and temperature that the steel is held above the $A_1$ temperature in Stage 2 of Method One, and the precise composition of the steel, is of importance in attaining the fine, spheroidized structure. The exact soaking time (ranging from minutes to hours) depends on the product, size, shape, temperature (as the temperature is increased, the soaking time is decreased), and alloying elements present (e.g., Cr, Si, Mo, Ni, Mn, etc.). For any specific new alloying element, only a few preliminary tests, obvious to those skilled in the art, need to be done to determine the correct time and temperature conditions for obtaining the desired fine-grained spheroidized structure.

Examples of the influence of time of soaking and of composition will be given after all six methods are presented.

Method Two

Figure 5:
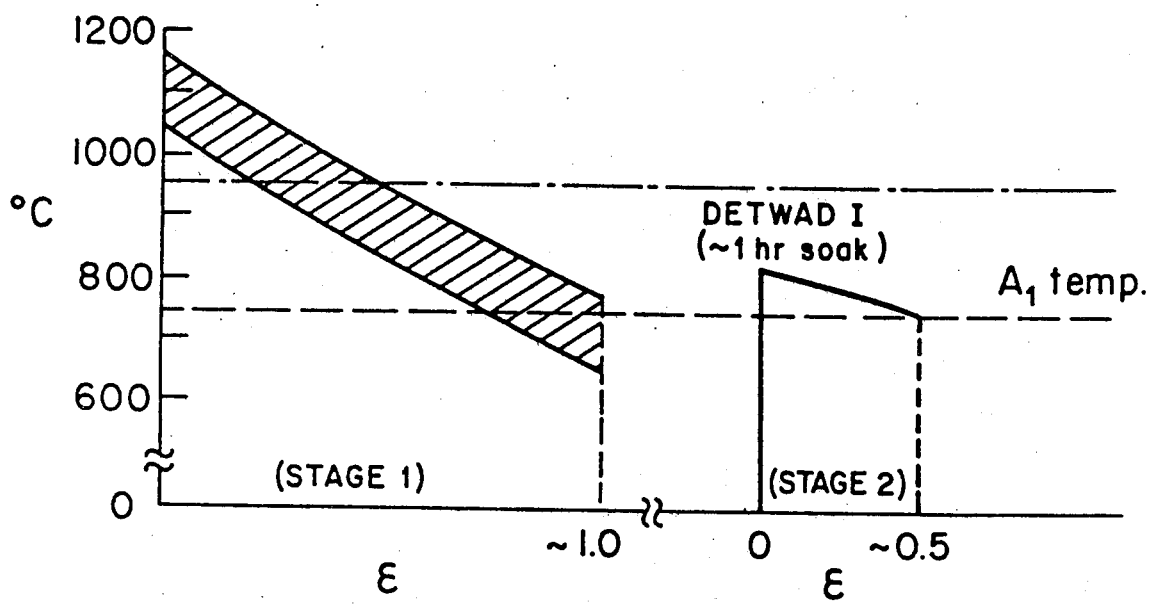
FIG. 5 is a schematic diagram representing the processing stages of Method Two involving DETWAD I.
Figure 6:
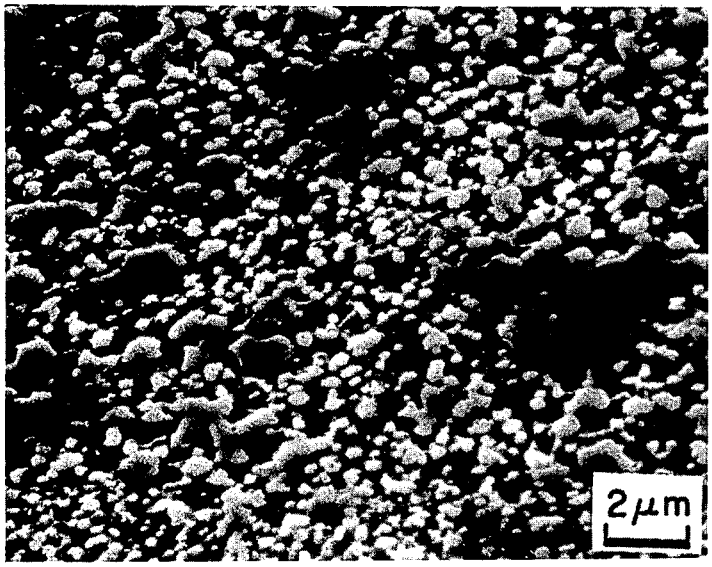
FIG. 6 is an example of the microstructure obtained from the processing stages of Method Two.

In a Method Two, two processing stages are used to obtain the desired structure. A schematic of a Method Two is shown in FIG. 5 for 1.5% C steel containing 1.5% Cr, 0.5% Mn and 0.5% Si. In the first stage an intermediate structure of spheroidized, pro-eutectoid cementite in a matrix of pearlite is obtained. This structure is achieved by deforming (hot and warm working) the UHC steel during cooling from a temperature in excess of the $A_{cm}$ transformation temperature in the single-phase austenite range (e.g., 1050° to 1200° C. ) to an intermediate temperature about the $A_1$ transformation temperature (in the range 650°–800° C.) followed by air cooling. A typical microstructure after the first stage is shown in FIG. 3. The second stage involves the DETWAD I process. In this stage the UHC steel is reheated to above the $A_1$ transformation temperature (approximately 780° C.) for about one hour such that pearlite is mostly dissolved into austenite in which the carbon is not uniformly distributed. The austenite will have a fine grain size because grain growth is inhibited by the presence of the spheroidized pro-eutectoid carbides. The UHC steel is then deformed only above the $A_1$ temperature, and is subsequently cooled, usually by air cooling, to room temperature. The deformation step above the $A_1$, DETWAD I, typically involves a strain of 0.3 to 2.0. The deformation refines the austenite grains, and subsequent cooling leads to fine grained ferrite and spheroidized cementite upon transformation. Pearlite formation is avoided because of the divorced eutectoid transformation. An example of the microstructure obtained by a Method Two for the 1.5% C UHC steel is shown in FIG. 6.

Method Three

Figure 7:
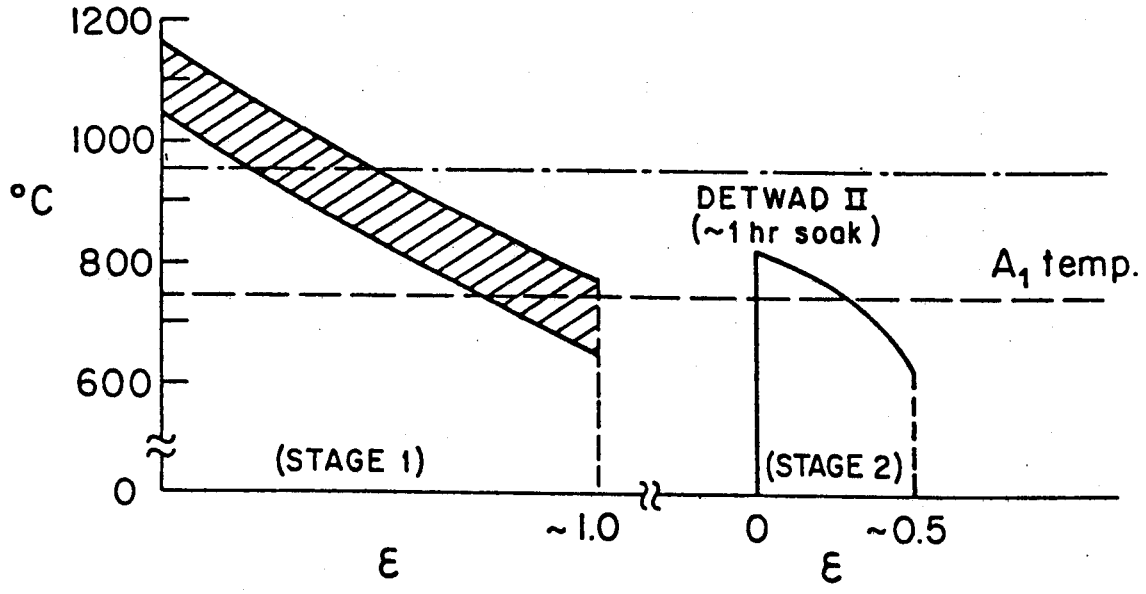
FIG. 7 is a schematic diagram representing the processing stages of Method Three involving DETWAD II.
Figure 8:
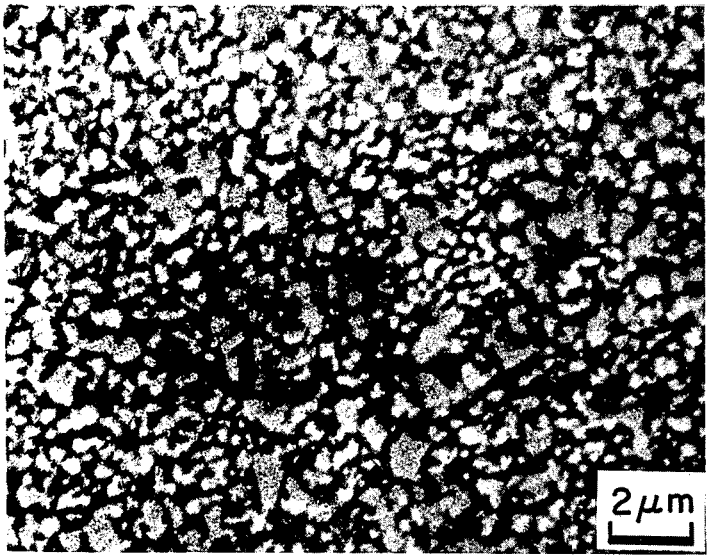
FIG. 8 is an example of the microstructure obtained from the processing stages of Method Three.

In a Method Three, two processing stages are used to obtain the desired structure. A schematic of a Method Three is shown in FIG. 7 for 1.5% C steel containing 1.5% Cr, 0.5% Mn and 0.5% Si. In the first stage an intermediate structure of spheroidized, pro-eutectoid cementite in a matrix of pearlite is obtained. This structure is achieved by deforming (hot and warm working) the UHC steel during cooling from a temperature in excess of the $A_{cm}$ transformation temperature in the single-phase austenite range (e.g., 1050° to 1200° C.) to an intermediate temperature about the $A_1$ transformation temperature (in the range 650°–800° C.) followed by air cooling. A typical microstructure after the first stage is shown in FIG. 3. The second stage involves the DETWAD II process. In this stage the UHC steel is reheated to above the $A_1$ transformation temperature (approximately 780° C.) for about one hour such that pearlite is mostly dissolved into austenite in which the carbon is not uniformly distributed. The austenite will have a fine grain size because grain growth is inhibited by the presence of the spheroidized pro-eutectoid carbides. The UHC steel is then deformed during cooling to a temperature below the $A_1$ temperature, and is subsequently cooled, usually by air cooling, to room temperature. The deformation step during the DETWAD II process typically involves a strain of 0.3 to 2.0. The deformation refines the austenite grains, and subsequent cooling leads to fine grain ferrite and spheroidized cementite upon transformation. The deformation below the $A_1$ temperature can further refine the ferrite grain size. Pearlite formation is avoided because of the divorced eutectoid transformation. An example of the microstructure obtained by a Method Three for the 1.5% C UHC steel is shown in FIG. 8.

Figure 9:
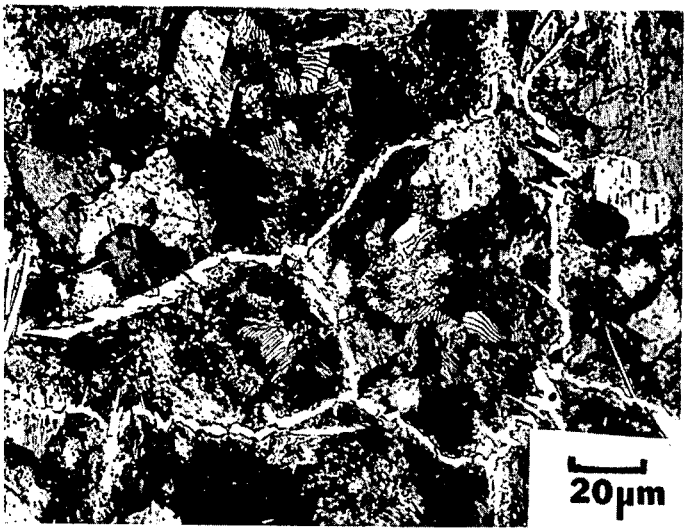
FIGS. 9*a* and 9*b* are examples of microstructures obtained from hot worked UHC steels.
FIG. 9*c* is an example of the microstructure obtained after DETWAD II processing of a hot worked UHC steel.
Figure 9:
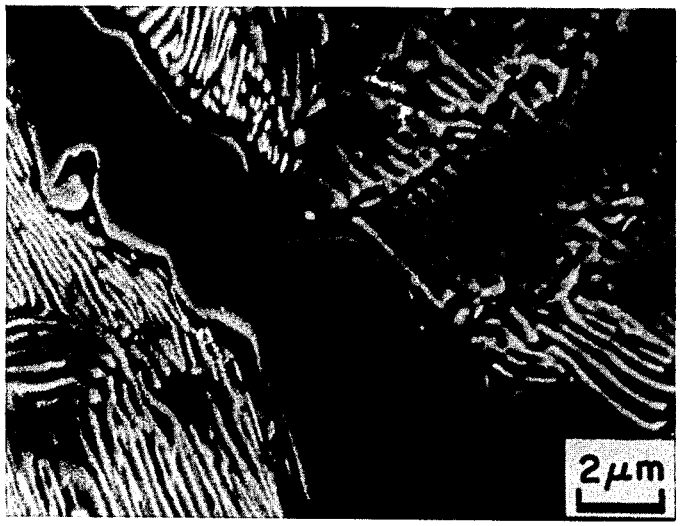
Figure 9:
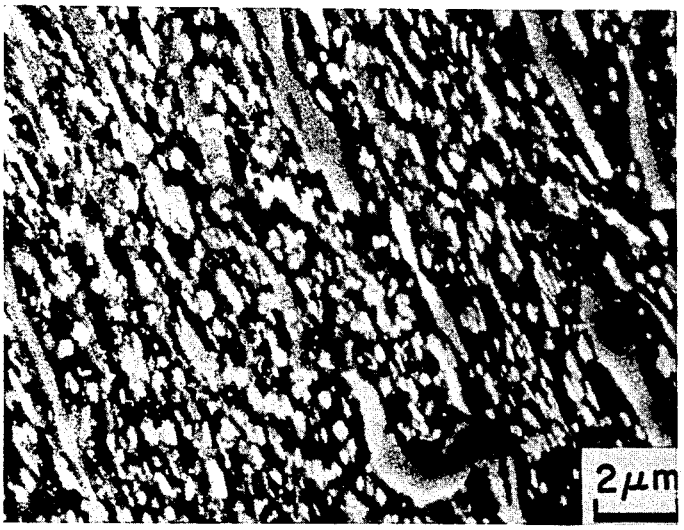

The first stage of hot and warm working is common to Method One, Two and Three. In order to produce a final structure that has spheroidized cementite in a fine ferrite matrix it is essential that this stage be incorporated. It is not possible, for example, to use DET, DETWAD I or DETWAD II on a hot worked UHC steel and produce a fully spheroidized cementite structure, as shown in FIG. 9. FIGS. 9(*a*) and 9(*b*) illustrate the typical starting structure of a hot worked steel, a pearlite structure containing massive plates of pro-eutectoid cementite. This example is for a 1.5% C UHC steel containing 1.5% Cr+0.5% Mn and 0.5% Si, which was air cooled from 1100° C. FIG. 9(*a*) is an optical micrograph and FIG. 9(*b*) is a scanning electron micrograph. The structure of the hot worked material, after a DETWAD II step (one hour soaking at 780° C. then rolling to a true strain of −1.6) is shown in FIG. 9(*c*). This structure is one containing spheroidized eutectoid cementite in a ferrite matrix (which was formerly pearlite) as expected. The massive pro-eutectoid cementite plates, however, are only flattened and not spheroidized, leading to an undesirable duplex structure. This is the type of structure that can be expected if the teachings of Grange (U.S. Pat. No. 3,459,599) are followed.

METHODS FOUR, FIVE AND SIX INVOLVING ONLY ONE STAGE PROCESSING

The next three methods involve the application of a DET or DETWAD stage to a starting structure in a UHC steel that is produced by an unspecified route. This starting structure consists of substantially spheroidized pro-eutectoid cementite in a matrix of eutectoid carbide and ferrite, or in a matrix of martensite. An example of one such starting structure is spheroidized pro-eutectoid cementite in a matrix of ferrite and spheroidized eutectoid cementite. Such a structure can be obtained by a powder metallurgy processing route or by the routes given in Methods One, Two and Three.

Method Four

A Method Four involves the application of a DET stage. In this method, the UHC steel is heated to approximately 50° C. above the $A_1$ temperature (e.g., 735°-850° C.) for a time period such that the carbides are mostly dissolved into austenite in which the carbon is not uniformly distributed. The austenite will have a relatively fine grain size because grain growth is inhibited by the presence of the spheroidized undissolved pro-eutectoid carbides. The UHC steel is then air cooled to produce a structure of fully spheroidized cementite in a fine ferrite matrix, as a result of the DET process.

Method Five

A Method Five involves the application of a DETWAD I stage. In a method Five the UHC steel is heated to approximately 50° C. above the $A_1$ temperature (e.g., 735°-850° C.) for a time period such that the carbides are mostly dissolved into austenite in which the carbon is not uniformly distributed. The austenite will have a relatively fine grain size because grain growth is inhibited by the presence of the spheroidized undissolved pro-eutectoid carbides. The UHC steel is then deformed only above the $A_1$ temperature, and is subsequently cooled, usually by air cooling, to room temperature. The deformation step above the $A_1$ temperature, namely the DETWAD I process, typically involves a strain of 0.3 to 2.0. The deformation refines the austenite grains, and subsequent cooling leads to fine grain ferrite and spheroidized cementite upon transformation. Pearlite formation is avoided because of the divorced eutectoid transformation.

Method Six

A Method Six involves the application of a DETWAD II stage. In a Method Six the UHC steel is heated to approximately 50° C. above the $A_1$ temperature (e.g., 735°-850° C.) for a time period such that the carbides are mostly dissolved into austenite in which the carbon is not uniformly distributed. The austenite will have a relatively fine grain size because grain growth is inhibited by the presence of the spheroidized undissolved pro-eutectoid carbides. The UHC steel is then deformed only above the $A_1$ temperature, and is subsequently cooled, usually by air cooling, to room temperature. The deformation step above the $A_1$ temperature, namely the DETWAD II process, typically involves a strain of 0.3 to 2.0. The deformation refines the austenite grains, and subsequent cooling leads to fine grain ferrite and spheroidized cementite upon transformation. The deformation below the $A_1$ temperature can further refine the ferrite grain size. Pearlite formation is avoided because of the divorced eutectoid transformation.

FACTORS INFLUENCING STRUCTURES OBTAINED FROM DET AND DETWAD PROCESSING

All six methods described above, i.e, Methods One, Two, Three, Four, Five and Six, involve a common transformation phenomenon, namely the divorced eutectoid transformation. The acronym, DET, is used when the divorced eutectoid transformation occurs without associated deformation, and the acronym DETWAD is used when the same type of transformation occurs with associated deformation.

An important variable in achieving the desired structure of the present invention by DET or DETWAD is the time and temperature of soaking above the $A_1$ temperature. Some of the factors that need to be taken into account in establishing the soaking conditions were described in Method One. The principal objective is to select a time and temperature such that, (1) the carbon is inhomogeneously distributed in the austenite and (2) the undissolved spheroidized carbides are present in such a way that austenite grain growth is inhibited.

The soaking conditions to achieve these two states are determined by a small number of experiments. Only several soaking times at three or four temperatures above the $A_1$, followed by air cooling, need to be chosen by one of ordinary skill in the art, to determine the conditions for successful DET or DETWAD processing for a given UHC steel. The desired time-temperature conditions are dictated by the dissolution kinetics of the carbides. Alloying additions generally decrease the rate of dissolution of the carbides and allow for long soaking times and/or high soaking temperatures.

Figure 10:
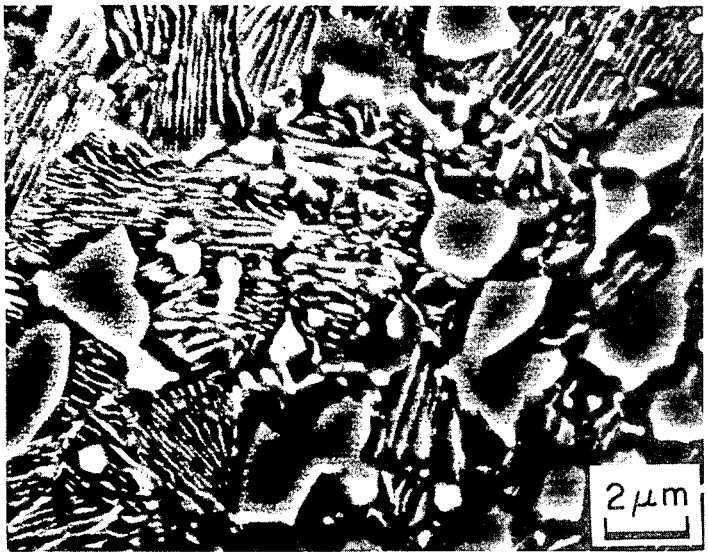
FIG. 10 is an example of the microstructure which results from the influence of chromium on the length of soaking time prior to DETWAD processing.
Figure 10:
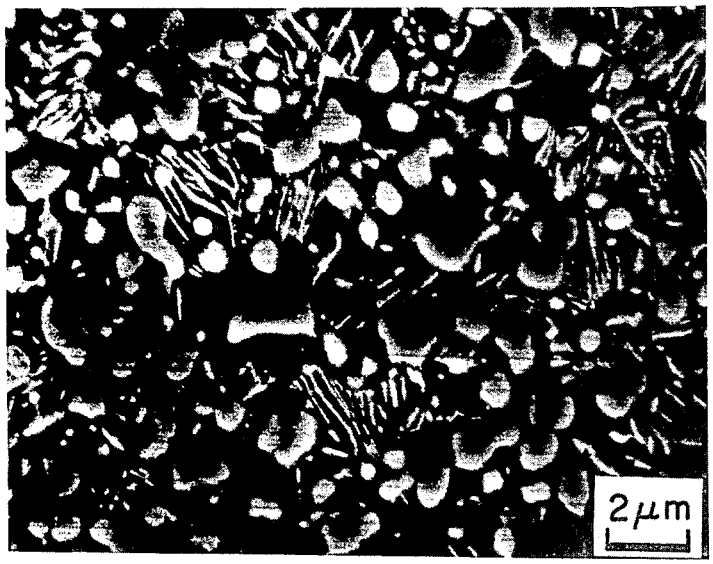

An example showing the influence of chromium in extending the time of soaking at 800° C. is shown in FIG. 10. An 8 hour soak at 800° C. for a plain carbon UHC steel (1.75% C+1% Mn) yields virtually no divorced eutectoid microstructure after air cooling (FIG. 10*a*). On the other hand, the same soaking time for a UHC steel alloyed with chromium (1.5% C+0.5% Mn+1.3% Cr) yields a microstructure dominated by a divorced eutectoid transformation during air cooling, (FIG. 10*b*). Thus, dilute alloying additions with carbide stabilizing elements such as chromium can be used to vary the soaking time and temperature for attainment of the desired DET and DETWAD structure in UHC steel.

Figure 11:
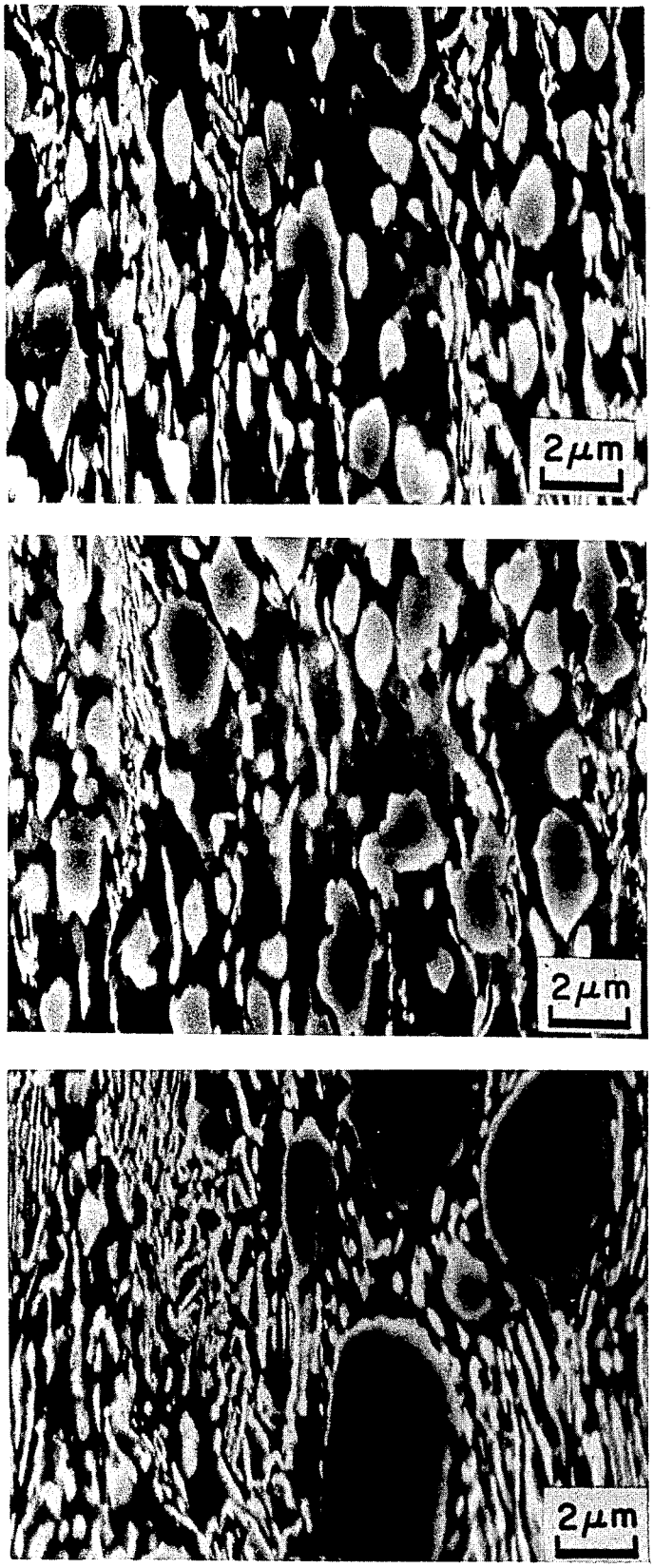
FIGS. 11*a*, 11*b* and 11*c* are examples of the microstructures obtained by varying soaking times prior to DETWAD processing.

Another variable influencing the attainment of a DET structure is the morphology of the starting structure. Coarse pearlite with spheroidized pro-eutectoid carbides will require more time of soaking than fine pearlite with spheroidized pro-eutectoid carbides to achieve a DET structure. A fully spheroidized structure will generally require a longer soaking time for achieving a DET structure than a structure consisting of pearlite and spheroidized pro-eutectoid carbides. For any given starting structure, a very long time at a typical soaking temperature, will result in pearlite as a transformation product. An example of this is shown in FIG. 11 for a UHC steel containing 1.25% C and 0.5% Mn. The starting structure of this material consisted of fine grain ferrite with spheroidized cementite. The UHC steel was heated to 788° C. for three different times (30 minutes, 1 hour and 48 hours), followed by a DETWAD II step. The structure for the UHC steel soaked 30 minutes, followed by DETWAD II is shown in FIG.

11(*a*). The structure is principally a fully spheroidized structure. On the other hand, the structure for the UHC steel soaked for 48 hours, followed by DETWAD II, is shown in FIG. 11(*c*). The structure is principally pearlite with coarse spheroidized pro-eutectoid carbides. For an intermediate soaking time (1 hour) some pearlite is shown to result, as shown in FIG. 11(*b*).

Various other modifications and adaptations of the invention will be apparent to the person skilled in the art after reading the foregoing disclosure without departing from the spirit and scope of the invention and it is intended that all such modifications and adaptations come within the scope of the appended claims.

What the claimed is:

1. A method for processing ultrahigh carbon steel employing a divorced eutectoid transformation comprising the steps of:

(a) heating an ultrahigh carbon steel with a carbon content from about 1.0% to 2.1% to a temperature in excess of the $A_{cm}$ transformation temperature, to form an austenite matrix in which substantially all of the carbon is dissolved;

(b) cooling the steel treated in step (a) from the $A_{cm}$ temperture to about the $A_1$ transformation temperature, and deforming the steel during at least part of the cooling step;

(c) cooling the steel treated in step (b) to below the $A_1$ transformation temperature to form pearlite and ferrite;

(d) reheating the steel treated in step (c) to a soaking temperature approximately 50° C. above the $A_1$ temperature;

(e) soaking the steel at a temperature above $A_1$ treated in step (d) in the soaking temperature range for a sufficient time such that the major portion of the pearlite is dissolved into the austenite matrix in which the carbon is not uniformly distributed; and (f) cooling at a rate equivalent to air cooling a second time to below the $A_1$ transformation temperature.

2. The method of claim 1 in which the steel treated in step (e) is non-isothermally deformed during step (f) before the steel is cooled to the $A_1$ transformation temperature.

3. The method of claim 1 in which the steel treated in step (e) is non-isothermally deformed during step (f) both above at and below the $A_1$ transformation temperature.

4. A method for processing ultrahigh carbon steel comprising the steps of:

(a) heating an ultrahigh carbon steel with a carbon content from about 1.0% to 2.1%, containing substantially spheroidized pro-eutectoid carbides in a matrix of ferrite and cementite, to a soaking temperature approximately 50° C. above the $A_1$ temperature;

(b) maintaining the steel treated in step (a) at a soaking temperature for a time sufficient such that the eutectoid carbides are dissolved into the austenite in which the carbon is not uniformly distributed; and (c) cooling at a rate equivalent to air cooling the steel of step (b) to below the $A_1$ transformation temperature.

5. The method of claim 4 in which the steel treated in step (b) is deformed during step (c) before the steel is cooled to the $A_1$ transformation temperature.

6. The method of claim 4 in which the steel treated in step (b) is deformed during the step (c) both above and below the $A_1$ transformation temperature.

7. A method for processing ultrahigh carbon steel comprising the steps of:

(a) heating an ultrahigh carbon steel with a carbon content from about 1.0% to 2.1%, containing substantially spheroidized pro-eutectoid carbides in a matrix of martensite, to approximately 50° C. above the $A_1$ temperature (b) maintaining the steel treated in step (a) at a soaking temperature for a time sufficient such that the eutectoid carbides are dissolved into the austenite in which the carbon is not uniformly destributed; and (c) cooling at a rate equivalent to air cooling the steel of step (b) to below the $A_1$ transformation temperature.

8. The method of claim 7 in which the steel treated in step (b) is deformed during step (c) before the steel is cooled to the $A_1$ transformation temperature.

9. The method of claim 7 in which the steel treated in step (b) is deformed during step (c) both above and below the $A_1$ transformation temperature.

* * * * *